United States Patent [19]

Krase et al.

[11] 4,025,780

[45] May 24, 1977

[54] FLUORESCENT LIGHT FIXTURE

[75] Inventors: Kenneth P. Krase, Chicago; Kenneth R. Hawkins, Gurne, both of Ill.

[73] Assignee: Kenall Manufacturing Company, Chicago, Ill.

[22] Filed: May 20, 1976

[21] Appl. No.: 688,164

[52] U.S. Cl. ..... 240/51.11 R; 240/41.55

[51] Int. Cl.[2] ..... H05B 33/02

[58] Field of Search ..... 240/51.11 R, 51.11 A, 240/51.12, 41.55, 9 R

[56] References Cited

UNITED STATES PATENTS

| | | | |
|---|---|---|---|
| 3,209,140 | 9/1965 | Nieder-Westermann et al. | 240/51.11 R |
| 3,329,811 | 6/1967 | Schiffer et al. | 240/51.11 R |
| 3,748,460 | 7/1973 | Price | 240/51.11 R |
| 3,755,666 | 8/1973 | Edgeington, Jr. | 240/51.11 R |
| 3,770,952 | 11/1973 | Trowbridge | 240/51.11 R |

*Primary Examiner*—Edna M. O'Connor

*Attorney, Agent, or Firm*—Richard O. Gray, Jr.

[57] ABSTRACT

A fluorescent light fixture is disclosed which comprises an elongate base plate member adapted to be mounted on a wall or other support and having inturned side flanges forming oppositely disposed channels for frictionally retaining marginal portions of the side walls of an inverted tray member which has a truncated triangle cross section and on the open ends of which are mounted lamp receiving sockets connected by wiring to a ballast member mounted on the inside of the tray. The tray member is of resilient material permitting the side walls to be contracted along the length thereof for insertion of the marginal portions in the side channels on the base plate member. The base plate member has end walls with portions bendable to a position over the ends of the support member to lock the latter in place and a readily detachable light diffusing lens member is provided for enclosing the assembly including a lamp mounted in the lamp sockets.

7 Claims, 6 Drawing Figures

FLUORESCENT LIGHT FIXTURE

This invention relates to lighting fixtures and is more particularly concerned with improvements in fluorescent lamp fixtures which are suitable for mounting on a ceiling, a vertically disposed wall surface or any similar supporting structure.

Fluorescent lighting fixtures of various designs have been developed heretofore and a number of different designs have been accepted commercially. Generally, these have taken the form of a base member or mounting plate for attachment to a wall or other supporting structure and which constitutes a support for the lamp holders or sockets which are mounted in longitudinal spaced relation together with the ballast and associated wiring. A cover in the form of an inverted channel may be provided which, when secured on the base, co-operates with the latter in forming an enclosure for the ballast and associated wiring. The base may have end members which may serve to support a light transmitting lens and which may co-operate with the lens in forming an enclosure for the lamp and the associated current supplying elements. In other designs, which have been employed commercially, particularly in workshops and similar locations, an elongate box encloses the ballast and associated wiring while lamp holders are mounted at opposite ends and there may be a reflector arrangement which leaves the lamp exposed. In all of these designs little attention has been paid to convenience in assembling the fixture and in disassembling the fixture when repair or replacement of ballast, wiring and/or sockets becomes necessary. It is a general object, therefore, to provide an improved fluorescent lighting fixture which has a minimum of parts, which may be quickly assembled and disassembled with the help of conventional tools, and which may be manufactured economically.

A more specific object of the invention is to provide an improved fluorescent lighting fixture which comprises a small number of parts which are readily assembled and disassembled, so as to afford maximum economy of time and effort in both the initial installation and in any subsequent requirement for repair or replacement of parts.

A still more specific object of the invention is to provide an improved fluorescent lighting fixture which is adapted to be mounted on a wall or other supporting structure by means of a fixed base plate and which has an associated tray-forming member detachably connected thereto with lamp holders, ballast and associated wiring mounted on the tray-forming member so as to be concealed, except for portions of the lamp holders, when the tray is mounted on the base plate while being readily accessible for repair or replacement upon separation of the tray-forming member from the fixed base plate.

Another object of the invention is to provide an improved fluorescent lighting fixture wherein a base mounting plate is arranged to frictionally hold a compartment forming, readily detachable tray member on which lamp sockets, ballast and associated wiring are carried so that these elements are readily accessible for repair or replacement upon detaching the tray member from the base plate while the ballast and associated wiring are disposed in the compartment when the tray member is attached to the base plate.

To this end the invention as claimed herein is embodied in a fluorescent lighting fixture which employs an elongate base plate for mounting the fixture on a wall or other supporting structure, which base plate has side edge formations for frictionally retaining margins of the side walls of an inverted tray member on the inside of which a ballast is mounted with associated wiring which extends to the ends of the tray member and connects with socket members for mounting a lamp on the outside of the tray member, the tray member side walls being of resilient material so as to enable them to be contracted for frictional engagement with base plate edge formations and the base plate member having end walls with portions which may be positioned over the ends of the tray member to lock the tray member on the base plate whereby the tray member may be readily released and detached from the base plate with the lamp sockets and connected wiring and ballast which is mounted thereon thereby enabling these elements to be easily examined and repaired or replaced when necessary.

The aforesaid objects and other objects and advantages of the invention will be best understood when reference is made to the preferred form of the lighting fixture described herein and illustrated in the accompanying drawings wherein.

Figures 1, 2, 3, 4, 5, 6:
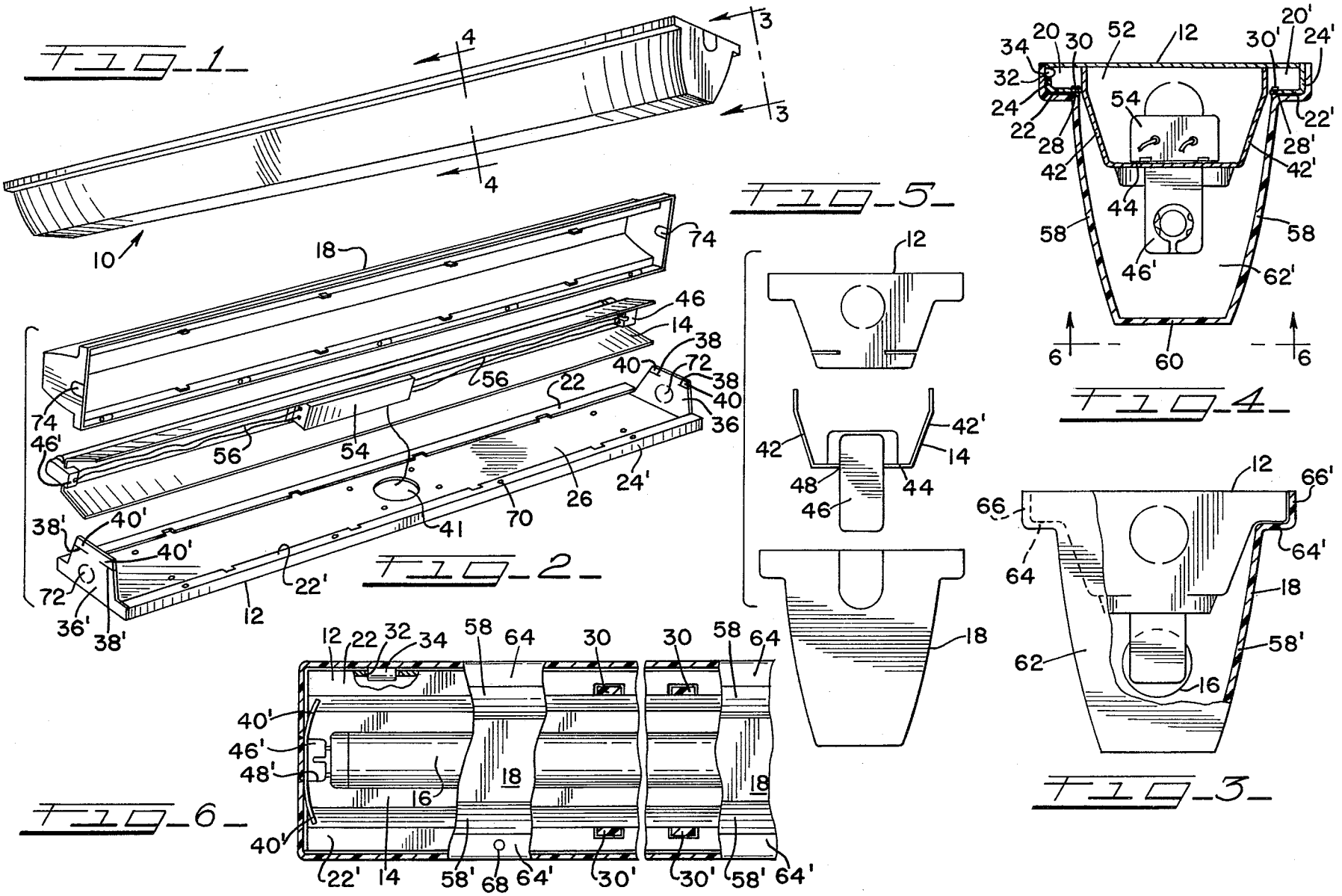
FIG. 1 is a perspective view of a lighting fixture which embodies the principal features of the invention, the fixture being mounted on an overhead support such as a ceiling of a room or similar area.
FIG. 2 is an exploded perspective view of the fixture of FIG. 1.
FIG. 3 is an end elevational view taken on the line 3—3 of FIG. 1, to an enlarged scale and with portions broken away.
FIG. 4 is a cross sectional view taken on the line 4–4 of FIG. 1, to an enlarged scale.
FIG. 5 is an exploded end elevational view.
FIG. 6 is a partial plan view at one end of the fixture with portions broken away.

Referring first to FIGS. 1 and 2, the fluorescent light fixture 10, which is shown assembled and installed on a ceiling or other overhead support structure in FIG. 1, comprises an elongate base plate 12 having the form of a shallow tray secured in downwardly opening relation, an associated member 14 in the form of an open ended tray on which the lamp 16 and its associated sockets and current supply elements are carried and a light transmitting lens 18. The tray member 14 is detachably secured on the base plate 12 in compartment-forming relation and the lens 18 is secured on the base plate 12 so as to enclose the lamp and its associated elements.

The base plate 12 is formed of sheet metal, such as, aluminum or steel, and is of the length required for accommodating the size lamp 16 which it is desired to use. The member 12 has longitudinal side edge formations derived by bending marginal portions inwardly so as to form parallel side channels 20, 20′ with relatively narrow marginal flange portions 22, 22′ extending a short distance inwardly from narrow, vertically disposed side wall portions 24, 24′. The flange portions 22, 22′ are spaced an appreciable distance from the inside face 26 of the member 12 and in a horizontal plane generally parallel with the plane of face 26. The flange portions 22, 22′ are provided on the inside edges with spaced notches 28, 28′ for seating therein positioning lugs 30, 30′ (FIG. 6) on the lens member 18 while the one side wall portion 24 is provided with spaced apertures 32 for receiving hinge forming positioning lugs 34 on the lens member 18. The member 12 has end wall formations 36, 36' of bendable metal material disposed in planes generally normal to the plane of the inside face 26. Each of the end wall members 36, 36' has horizontal cuts 38, 38' in the free marginal portions resulting in tab-forming corner sections 40, 40' which are adapted to be bent inwardly over the ends of the member 14 on which the lamp and associated elements are mounted. When bent into position over the ends of the member 14, as shown in FIG. 6, the tab members 40, 40' serve as a means for securely holding or clamping the member 14 in position on the base plate 12. The tab members 40, 40' may be readily bent into or out of locking position with the use of a pair of pliers or other appropriate tool. A center aperture 41 is provided for wiring connection into a junction box or the like.

The lamp carrying member 14 is in the form of an open ended tray with a truncated triangular cross section. In the position shown in FIGS. 3 to 5, it has side walls 42, 42' which are laterally spaced and disposed opposite each other in planes extending in diverging relation from the plane of a connecting bottom wall 44. The tray member 14 is fabricated from metal sheeting having a degree of resiliency which will permit the free edge portions of the side walls 42, 42' to be moved toward each other by applying normal hand gripping pressure to the outside faces. The free edges of the side walls 42, 42' are normally spaced a distance apart relative to the space between the oppositely disposed, inner edges of the flange portions 22, 22' on the base plate 12 so that the side walls 42, 42' may be manually squeezed or contracted to a position where the margins may be inserted in the side channel formations 20, 20' on the base plate 12 and allowed to expand or move apart so as to be seated in frictional engagement in the channels 20, 20' with the side wall edges engaging the inside face 26 of the base plate 12 and the adjoining marginal portions of the outside faces engaging the inner edges of the flange members 22, 22'. The wall 44 is of substantial width and at its opposite open ends lamp holders or lamp receiving socket members 46, 46' are mounted in notches 48, 48' so as to support a lamp member 16. The member 14 is of a length slightly less than the distance between the end walls 36, 36' on the base plate 12 so as to fit between the same. The member 14 is of a depth sufficient to provide, in co-operation with the base plate 12, a compartment 52 (FIG. 4) which will accommodate the ballast 54 and the associated wiring 56, all of which are mounted on the inside of the tray member.

The lens member 18 is formed of a light transmitting plastic material and is of a size and shape to encompass the lamp 16, the supporting tray 14 and the base plate 12 when these members are assembled. It is of the same general truncated, triangular cross section as the member 14 with oppositely disposed side walls 58, 58', a connecting bottom wall 60 and end walls 62, 62'. Flange formations comprising horizontal portions 64, 64' and vertical portions 66, 66' are provided on the free edges of the side walls 58, 58' which are dimensioned to fit over and seat on the flange formations 22, 24 and 22', 24' on the plate member 12. The horizontal flange portions 64, 64' have vertically extending, longitudinally spaced positioning lugs 30, 30' on the inner edges which are adapted to seat in the notches 28, 28' in the flange portions 22, 22' of the plate member 12. The vertical flange portion 66 is provided with inwardly extending, longitudinally spaced lugs 34 which are adapted to seat in the apertures 32 in the flange side wall portion 24. The horizontal flange portion 64' is provided with screw holes 68 for fastening the lens 18 when it is positioned with the lugs 34 in the apertures 32 and closed on the lamp assembly, the holes 68 aligning with co-operating holes 70 in the flange member 22' of the base plate 12. Also, the lens 18 is provided with knock-out portions 74 in the end walls which will align with knock-out portions 72 in the end walls 36, 36' of the base plate 12 permitting wiring connection to a current source through either end if necessary.

The arrangement for mounting the lens 18 on the base plate member 12 may be modified by eliminating the lug members 34 on the lens flange portion 66 and the associated apertures 32 in the flange portion 24 of the base member 12 and providing screw receiving holes in the flange portions 64 and 22 of the same character as the screw receiving holes in the flange portions 64' and 22' on the opposite side of the fixture assembly enabling the lens to be secured by screws on both sides of the assembly.

While, in the form shown, the fixture is designed for a single lamp, the same arrangement may be used for a plurality of lamps. Also, provision may be made on the tray member 14 for mounting starter elements if required.

We claim:

1. A fluorescent lighting fixture comprising an elongate, generally rectangular base plate for mounting the fixture which base plate has flange formations along opposite side edges with portions in overlying spaced relation to the inside face of said base plate, an elongate, open ended tray member of a length to fit between the ends of said base plate and having a truncated, triangular cross section with side walls arranged to seat the edges on the base plate and beneath the flange formations thereby to secure said tray member in compartment forming relation on said base plate, means mounting a pair of lamp receiving socket members at opposite ends of said tray member which socket members extend in a direction for mounting a lamp on the outside of said tray member, means mounting a ballast member and associated wiring on the inside of said tray member so as to be enclosed in said compartment, said base plate having end wall members with portions adapted to be moved into overlying relation to the ends of said tray member when it is seated between said end members on said base plate so as to lock the same in compartment forming position on said base plate.

2. A fluorescent lighting fixture as set forth in claim 1 wherein said tray member has side walls which are normally spaced apart at their free edges a distance greater than the innermost portions of said flange formations and which are of sufficient resiliency to be sprung inwardly manually so as to enable free marginal portions thereof to be positioned beneath said flange formations for frictional retention therein when released.

3. A fluorescent lighting fixture as set forth in claim 1 wherein said base plate has end wall members of a dimension in a direction normal to the plane of the base plate which is greater than the distance from the plane of the base plate to end portions of said tray member and means on said end wall members which are swingable out of the plane of said end wall members and into overlying relation with said end portions of said tray member.

4. A fluorescent lighting fixture as set forth in claim 1 wherein said base plate has end wall members of a dimension in a direction normal to the plane of the base plate which exceeds the distance from the plane of the base plate, at the ends thereof, to end portions of said tray member and said end wall members having tab members cut therefrom which are bendable into overlying relation and in edge engagement with said end portions of said tray member.

5. A fluorescent lighting fixture as set forth in claim 1 wherein said base plate flange formations comprise relatively narrow outside wall panels disposed in planes which are generally normal to the plane of the base plate and integral inturned narrow panels with their inner edges in oppositely disposed relation and spaced apart a lesser distance than the distance between said outside wall panels and providing for edge engagement with marginal portions of the side walls of side tray member on lines spaced a substantial distance from the edges of said side walls.

6. A fluorescent fixture as set forth in claim 1 wherein a light transmitting lens member is provided which is of a size to encompass the base plate and associated tray member when a lamp is mounted thereon and having side walls with marginal portions shaped to mate with said base plate flange formations, separable hinge means for connecting said base plate and lens member along one side of said base plate and fastener means along the opposite side thereof for securing said lens member on said base plate.

7. In a fluorescent lighting fixture having a generally rectangular base plate member with end walls and side flange formations along opposite sides thereof and a tray member having open ends and carrying thereon lamp holders at opposite ends, a ballast member and associated wiring, which tray member is constructed to be positioned in compartment forming relation on said base plate member between said side flange formations and between said end walls, the improvement which comprises bendable means on said end walls of said base plate which may be swung into a position overlying the ends of said tray member to secure said tray member in position on said base plate member.

* * * * *